US005493181A

United States Patent [19]

Shackle et al.

[11] Patent Number: 5,493,181

[45] Date of Patent: Feb. 20, 1996

[54] CAPACITIVE LAMP OUT DETECTOR

[75] Inventors: Peter W. Shackle, Arlington Heights; Randy G. Russell, Glen Ellyn; Kent E. Crouse, Hanover Park, all of Ill.

[73] Assignee: Energy Savings, Inc., Schaumburg, Ill.

[21] Appl. No.: 436,789

[22] Filed: May 8, 1995

Related U.S. Application Data

[63] Continuation of Ser. No. 216,649, Mar. 22, 1994, abandoned.

[51] Int. Cl.[6] ..... H05B 39/00

[52] U.S. Cl. ..... 315/241 R; 315/209 R; 315/DIG. 7

[58] Field of Search ..... 315/241 R, 244, 315/225, 127, DIG. 7, 209 R

[56] References Cited

U.S. PATENT DOCUMENTS

| | | | |
|---|---|---|---|
| 3,621,331 | 11/1971 | Barron | 315/207 |
| 4,414,442 | 11/1983 | Hanlet | 315/290 |
| 4,503,363 | 3/1985 | Nilssen | 315/307 |
| 4,544,863 | 10/1985 | Hashimoto | 315/209 R |
| 4,553,070 | 11/1985 | Sairanen | 315/209 R |
| 4,554,487 | 11/1985 | Nilssen | 315/225 |
| 4,562,383 | 12/1985 | Kerscher et al. | 315/225 |
| 4,616,158 | 10/1986 | Krummel et al. | 315/225 |
| 4,862,042 | 8/1989 | Herrick | 315/291 |
| 4,914,558 | 4/1990 | Flickinger | 315/DIG. 7 |
| 5,004,955 | 4/1991 | Nilssen | 315/119 |
| 5,023,516 | 6/1991 | Ito et al. | 315/DIG. 7 |
| 5,068,571 | 11/1991 | Schoofs | 315/225 |
| 5,111,114 | 5/1992 | Wang | 315/225 |
| 5,142,202 | 8/1992 | Sun et al. | 315/225 |
| 5,293,099 | 3/1994 | Bobel | 315/225 |

FOREIGN PATENT DOCUMENTS 8600851 11/1986 WIPO .

*Primary Examiner*—Robert J. Pascal
*Assistant Examiner*—Darius Gambino
*Attorney, Agent, or Firm*—Cahill, Sutton & Thomas

[57] ABSTRACT

An electronic ballast includes a boost circuit, a low voltage control circuit, and a driven inverter in a half-bridge, push-pull, series resonant, parallel loaded configuration. The boost circuit includes a low voltage output for powering the control circuit. In the event of a fault, the control circuit shuts off the boost circuit and the inverter. A sense capacitor is in series with the lamps and the voltage across the capacitor prevents a timer in the control circuit from shutting off the ballast. The timer circuit waits a period longer than the time it takes for the lamps to start normally. The sense capacitor is either in series with the lamp across the resonant capacitor or is in series with the resonant capacitor.

17 Claims, 3 Drawing Sheets

CAPACITIVE LAMP OUT DETECTOR

This application is a continuation of prior application Ser. No. 08/216,649 filed Mar. 22, 1994, now abandoned.

BACKGROUND OF THE INVENTION

This invention relates to electronic ballasts for fluorescent lamps and, in particular, to electronic ballasts which stop operating in response to a fault condition such as a defective lamp or a missing lamp.

A gas discharge lamp, such as a fluorescent lamp, is a non-linear load to a power line, i.e. the current through the lamp is not directly proportional to the voltage across the lamp. Current through the lamp is zero until a minimum voltage is reached, then the lamp begins to conduct. Once the lamp conducts, the current will increase rapidly unless there is a ballast in series with the lamp to limit current.

A resistor can be used as a ballast but a resistor consumes power, thereby decreasing efficiency, measured in lumens per watt. A "magnetic" ballast is an inductor in series with the lamp and is more efficient than a resistor but is physically large and heavy. A large inductor is required because impedance is a function of frequency and power lines operate at low frequency (50–60 hz.)

An electronic ballast typically includes a rectifier for changing the alternating current (AC) from a power line to direct current (DC) and an inverter for changing the direct current to alternating current at high frequency, typically 25–60 khz. Since the frequency of the inverter is much higher than 50–60 hz., the inductors for an electronic ballast are much smaller than the inductor in a magnetic ballast.

Converting from alternating current to direct current is usually done with a full wave or bridge rectifier. A filter capacitor on the output of the rectifier stores energy for powering the inverter. The voltage on the capacitor is not constant but has a 120 hz "ripple" that is more or less pronounced depending on the size of the capacitor and the amount of current drawn from the capacitor.

Some ballasts include a boost circuit between the rectifier and the inverter. As used herein, a "boost" circuit is a circuit which increases the DC voltage, e.g. from approximately 180volts (assuming a 120 volt input) to 300 volts or more for operating a lamp, and/or which provides power factor correction. "Power factor" is a figure of merit indicating whether or not a load in an AC circuit is equivalent to a pure resistance, i.e. indicating whether or not the voltage and current are sinusoidal and in phase. It is preferred that the load be the equivalent of a pure resistance (a power factor equal to one).

If a lamp is not connected to an electronic ballast while power is applied to the ballast, the voltages and currents within the ballast can become extremely high, destroying the ballast. In addition, if a lamp is disconnected from a ballast, the person disconnecting the lamp is exposed to the high voltages of the ballast, e.g. by touching the terminals at one end of the lamp while the other end of the lamp is connected to the ballast. Many ballasts are designed to generate extra high voltages initially, to assure an instantaneous or a rapid start of a lamp, then to reduce the voltage when the lamp is conducting. When a lamp is removed, the circuitry within such ballasts reverts to a start-up mode and produces an extra high output voltage at the very time a person may be touching the terminals of the lamp.

Some electronic ballasts include a transformer in the output stage to isolate the lamp circuit from electrical ground. An isolation transformer makes an electronic ballast heavy and expensive. This invention relates to electronic ballasts having what is known as a "direct coupled output", i.e. a path exists between the high voltage supply within the inverter and the output terminals of the inverter during each cycle of the AC output.

U.S. Pat. No. 5,004,955 (Nilssen) discloses an electronic ballast having a direct coupled output. The ballast includes a half-bridge, triggered, series resonant, parallel loaded inverter in which lamp current is sensed by a transformer winding in series with the lamps. A lack of current is interpreted as a fault and the inverter is disabled. The inverter is triggered on or off using RC timing circuits and attempts a re-strike every couple of seconds.

A boost circuit or the inverter, or both, can be self-oscillating, triggered, or driven. A driven circuit requires a source of pulses for operation and the pulses are provided by a timer circuit or a more complicated integrated circuit designed for ballasts or electronic power supplies. A triggered circuit typically incorporates a small pulse generator for starting the circuit into oscillation. A capacitor charging up to the firing voltage of a diac or other semiconductor switch is typically used in such circuits, e.g. the Nilssen patent. The pulse generator may or may not be disabled when the ballast is operating normally. A self-oscillating circuit is constructed in such a way that the applied voltage causes the circuit to begin oscillation and typically includes a resistor having a high resistance to provide a temporary bias for initiating oscillation.

U.S. Pat. No. 5,111,114 (Wang) discloses an electronic ballast having a direct coupled output. The ballast includes a half-bridge, triggered, series resonant, parallel loaded inverter in which lamp current is sensed as the voltage drop across an inductor in series with the lamps. Excess voltage is interpreted as a fault and the inverter is disabled. The inverter is triggered into oscillation using an RC/diac timing circuit in which the capacitor is discharged through a parallel transistor if a fault is sensed. An RC circuit controlling the parallel transistor has a longer time constant than the time constant of the RC/diac circuit. The Wang patent also discloses a large capacitor in series with the lamps, "large" being defined as at least ten times the capacitance of the resonant capacitor.

There are many other circuits described in the prior art for automatically shutting off a ballast in the event of a fault. There remains a need for an efficient ballast having automatic shut off capability, i.e. a ballast which dissipates little power in normal operation and in a shut down mode.

In view of the foregoing, it is therefore an object of the invention to provide an electronic ballast including a capacitive sensor for detecting a missing or defective lamp.

A further object of the invention is to provide an electronic ballast which automatically reduces the output voltage in the event of a fault without dissipating a large amount of power.

Another object of the invention is to provide an electronic ballast including automatic shut-off circuitry which dissipates very little power either during a fault condition or during normal operation of the ballast.

SUMMARY OF THE INVENTION

The foregoing objects are achieved in an electronic ballast including a boost circuit, a low voltage control circuit, and a driven inverter in a half-bridge, push-pull, series resonant, parallel loaded configuration. The boost circuit includes a low voltage output for powering the control circuit. In the event of a fault, the control circuit shuts off the boost circuit and the inverter. A sense capacitor is in series with the lamps and the voltage across the capacitor prevents a timer in the control circuit from shutting off the ballast. The timer circuit waits a period longer than the time it takes for the lamps to start normally. In one embodiment, the sense capacitor is in series with the lamps across the resonant capacitor and in another embodiment the sense capacitor is in series with the resonant capacitor.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
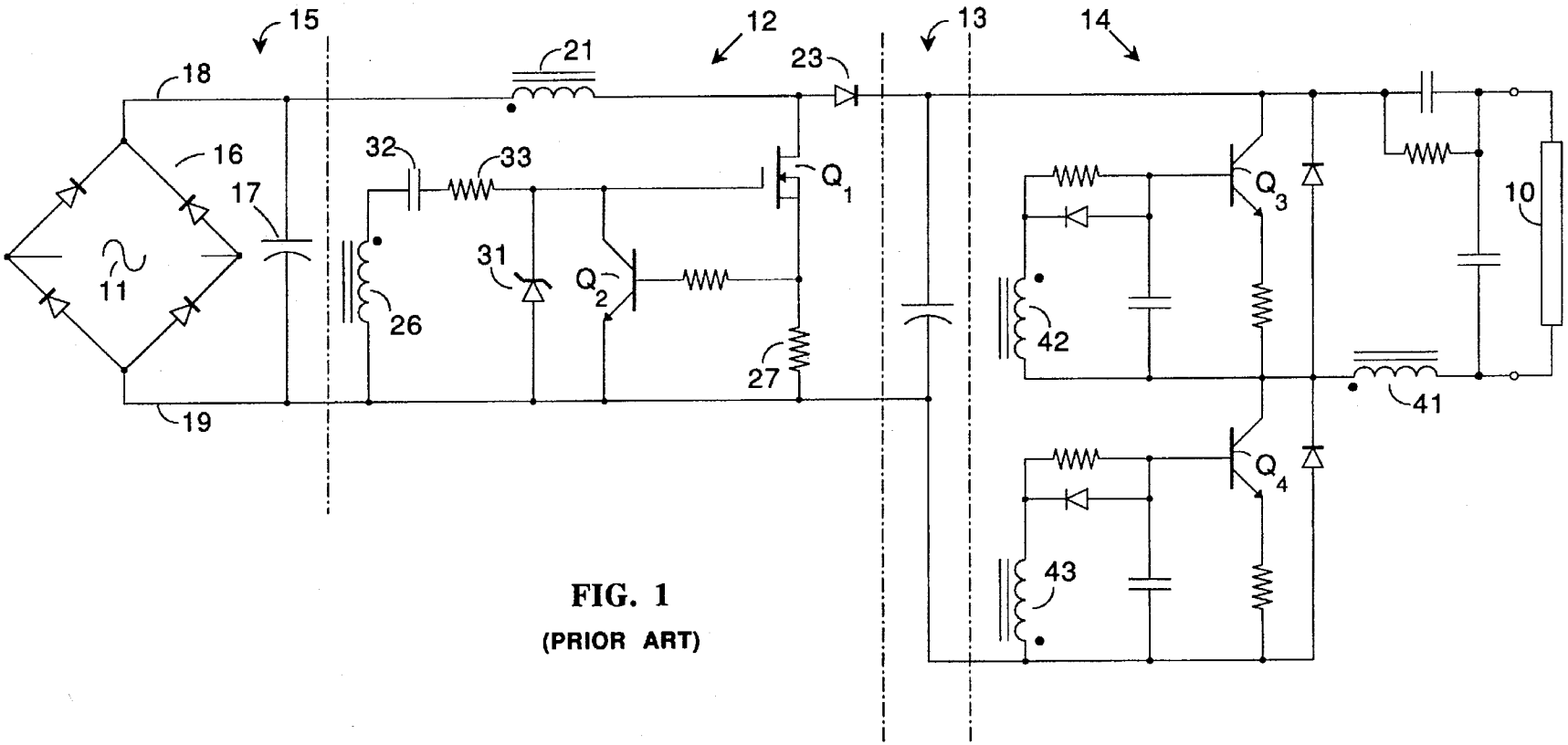
FIG. 1 (PRIOR ART)
FIG. 1 is a schematic of an electronic ballast of the prior art.

FIG. 1 illustrates the major components of an electronic ballast for connecting fluorescent lamp 10 to an AC power line, represented by waveform 11. The electronic ballast in FIG. 1 includes boost circuit 12, energy storage capacitor 13, and inverter 14. Boost circuit 12 increases the DC voltage from the rectifier and stores it on capacitor 13. Inverter 14 is powered by the energy stored in capacitor 13 and provides a high frequency, e.g. 30 khz, alternating current to lamp 10.

AC input 15 includes bridge rectifier 16 having DC output terminals connected to capacitor 17 by rails 18 and 19. If rectifier 16 were simply connected to capacitor 13, then the maximum voltage on capacitor 13 would be equal to approximately 1.4 times the r.m.s. value of the applied voltage. Instead, the voltage on capacitor 17 is increased to a higher voltage by a boost circuit including inductor 21, transistor $Q_1$, and diode 23. When transistor $Q_1$ is conducting, current flows from rail 18 through inductor 21 and transistor $Q_1$ to rail 19. When transistor $Q_1$ stops conducting, the field in inductor 21 collapses and the inductor produces a high voltage which adds to the voltage from bridge rectifier 16 and is coupled through diode 23 to capacitor 13. Diode 23 prevents current from flowing back to transistor $Q_1$ from capacitor 13.

A pulse signal must be provided to the gate of transistor $Q_1$ in order to periodically turn $Q_1$ on and off to charge capacitor 13. Inductor 26 is magnetically coupled to inductor 21 and provides feedback to the gate of transistor $Q_1$, causing transistor $Q_1$ to oscillate at high frequency, i.e. a frequency at least ten times the frequency of the AC power line, e.g. 30 khz.

Resistor 27, in series with the source-drain path of transistor $Q_1$, provides a feedback voltage which is coupled to the base of transistor $Q_2$. When the voltage on resistor 27 reaches a predetermined magnitude, transistor $Q_2$ turns on, turning off transistor $Q_1$. Resistor 27 typically has a small value, e.g. 0.5 ohms. Zener diode 31 limits the voltage on the gate of transistor $Q_1$ from inductor 26 and capacitor 32 and resistor 33 provide pulse shaping for the signal to the gate of transistor $Q_1$ from inductor 26.

In inverter 14, transistors $Q_3$ and $Q_4$ are series connected between rails 18 and 19 and conduct alternately to provide a high frequency pulse train to lamp 10. Inductor 41 is series connected with lamp 10 and is magnetically coupled to inductors 42 and 43 for providing feedback to transistors $Q_3$ and $Q_4$ to alternately switch the transistors. The oscillating frequency of inverter 14 is independent of the frequency of boost circuit 12 and is on the order of 25–50 khz. The arrangement of inverter 14 is known in the art as a half-bridge, push-pull inverter.

As illustrated in FIG. 1, neither boost circuit 12 nor inverter 14 is self-starting, triggered, or driven. Circuitry for starting oscillation is omitted for clarity in describing the basics of one type of ballast. In its simplest form, such circuitry is a high resistance connected between the high voltage rail and the base of transistor $Q_1$ and a high resistance connected between the high voltage rail and the base of transistor $Q_3$. These two resistors would make boost circuit 12 and inverter 14 self-starting.

Figure 2:
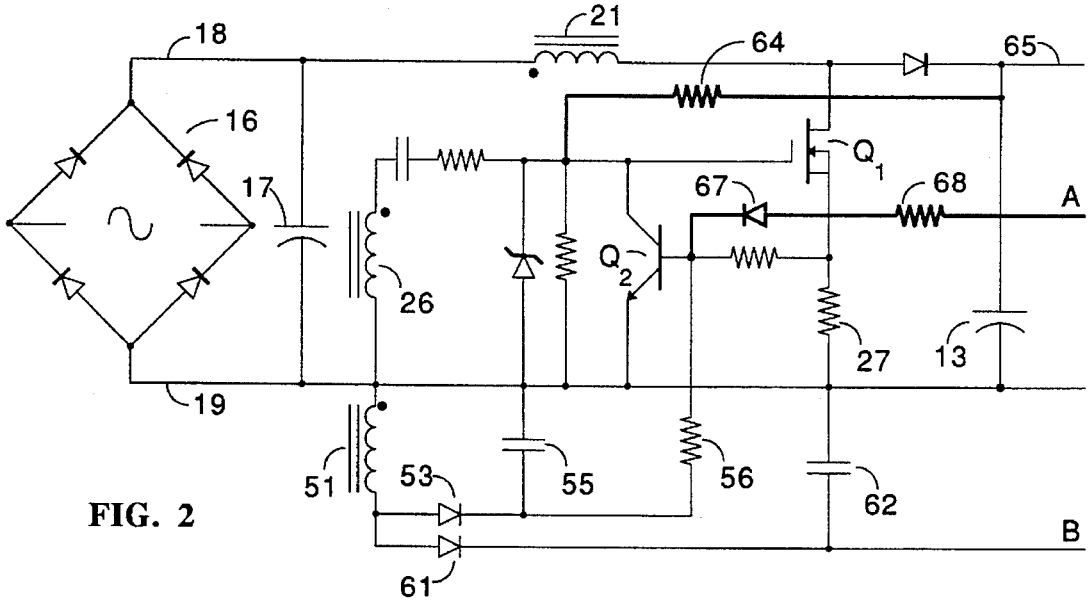
FIG. 2 is a schematic of a boost circuit constructed in accordance with one aspect of the invention.

FIG. 2 illustrates a boost circuit constructed in accordance with a preferred embodiment of the invention in which the boost circuit provides both low voltage, e.g. five volts, for powering other components of the ballast, and high voltage, e.g. 300 volts, for powering one or more lamps. Some elements in FIGS. 2 are drawn in heavier line to facilitate reading the schematic.

Inductor 51 is magnetically coupled to inductors 21 and 26. The voltage induced in inductor 51 therefore includes a high frequency component from the operation of transistor $Q_1$ and a low frequency component from the ripple voltage. The voltage from inductor 51 is coupled to a ripple detector including diode 53 and capacitor 55. The rectified voltage on capacitor 55 is coupled to the control electrode of transistor $Q_2$ by resistor 56. This portion of the circuit significantly improves power factor and harmonic distortion.

The boost circuit also includes diode 61 connected to inductor 51 and capacitor 62 connected between diode 61 and rail 19. The junction between diode 61 and capacitor 62 is brought out on line B. The output from capacitor 62 is a filtered, DC voltage, e.g. 5 volts, for powering other components within the ballast.

Resistor 64, connected between high voltage rail 65 and the gate of transistor $Q_1$, provides a DC path through the boost circuit for causing the boost circuit to begin oscillation. Resistor 64 has a high resistance, e.g. 660,000 ohms, and is of negligible effect once the boost circuit is oscillating. The boost circuit oscillates during each half cycle of the rectified input voltage, i.e. the boost circuit restarts 120 times per second with the bias provided from resistor 64. Line A is coupled to the base of transistor $Q_2$ through diode 67 and resistor 68. As more fully described with FIG. 4, a high voltage on line A turns on transistor $Q_2$ and quenches oscillation of the boost circuit.

Figure 3:
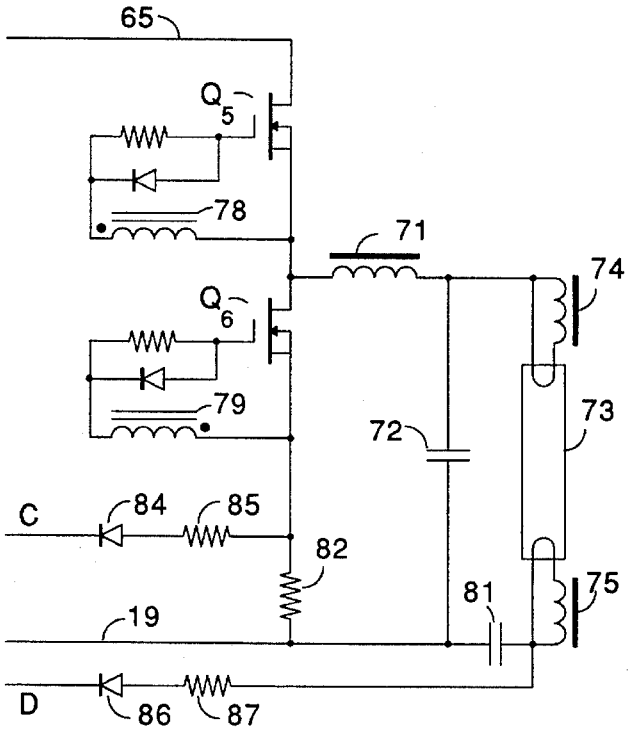
FIG. 3 is a schematic of an inverter constructed in accordance with the invention.

In FIG. 3, transistors $Q_5$ and $Q_6$ are connected in series between high voltage rail 65 and ground rail 19. One side of inductor 71 is connected to the junction of transistors $Q_5$ and $Q_6$. Capacitor 72 is connected between the other side of inductor 71 and ground, forming a series resonant LC circuit. Lamp 73 is connected in parallel with resonant capacitor 72. Inductors 74 and 75 are magnetically coupled to inductor 71 and provide power for the filaments of lamp 73. Transistors $Q_5$ and $Q_6$ alternately conduct at a frequency determined by a driving circuit (FIG. 4) which is magnetically coupled to transistors $Q_5$ and $Q_6$ by inductors 78 and 79.

Capacitor 81 is connected in series with lamp 73 across resonant capacitor 72. The voltage drop across capacitor 81 is coupled to line D by diode 86 and resistor 87. Line D is connected to the low voltage or control portion of the ballast, illustrated in FIG. 4. When lamp 73 is connected to the ballast and the ballast is operating normally, the voltage across capacitor 81 is approximately one-half the voltage between rail 65 and rail 19. In the absence of a lamp, or if a lamp is defective, then the voltage across capacitor 81 is considerably lower or zero. This low voltage is detected by the control circuit and the ballast is shut-off.

Diode 86 and resistor 87 draw a small direct current through lamp 73, causing a slight asymmetry in the current through the lamp and causing the D.C. voltage on capacitor 81 to be slightly less than one-half the voltage between rail 65 and rail 19. This is not detrimental but is an advantage because the small direct current prevents striations when dimming the lamp to low light levels. Providing alternating current and direct current while dimming a lamp is known in the art; see, for example, U.S. Pat. Nos. 3,621,331 (Barron) and 4,862,042 (Herrick), the latter having been published on Nov. 6, 1986, as PCT application No. PCT/US86/00581.

Resistor 82 is in series with transistors $Q_5$ and $Q_6$ and converts the current through transistor $Q_6$ to a voltage which is coupled to line C by diode 84 and resistor 85. Line C is also connected to the control portion of the ballast and an excessively high voltage across resistor 82 causes the ballast to shut off.

Figure 4:
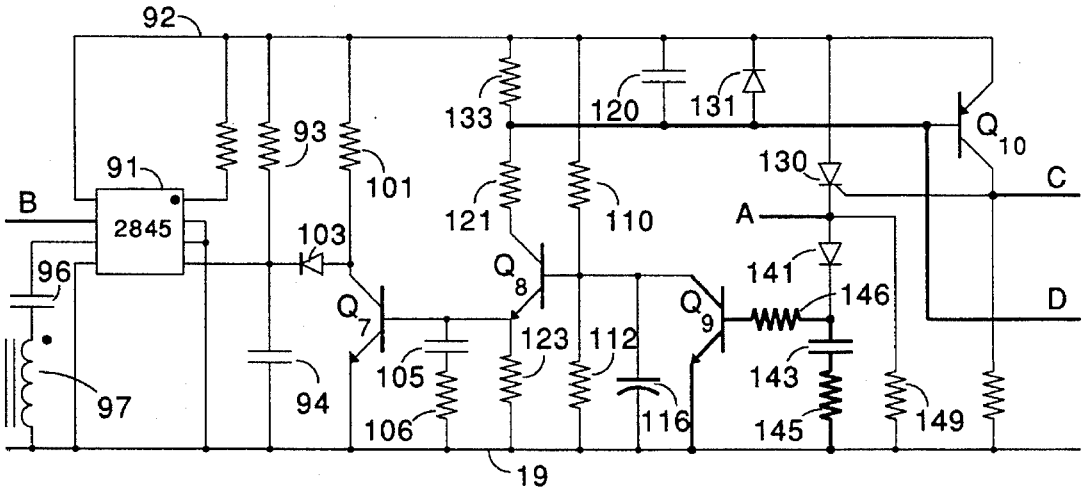
FIG. 4 is a schematic of the low voltage, control portion of an electronic ballast constructed in accordance with the invention.

FIG. 4 is a schematic of the low voltage or control portion of a ballast constructed in accordance with a preferred embodiment of the invention and illustrates the circuitry powered from line B (FIG. 2). Lines A and B of FIG. 4 correspond to lines A and B of FIG. 2. Lines C and D of FIG. 4 correspond to lines C and D of FIG. 3.

In FIG. 4, driver circuit 91 is powered from line B and produces a local, regulated output voltage which drives rail 92 to approximately 5 volts. In one embodiment of the invention, driver circuit 91 was a 2845 pulse width modulator circuit. Pin 1 of driver circuit 91 is indicated by a dot and the pins are numbered consecutively clockwise. The particular chip used to implement the invention included several capabilities which are not needed, i.e. the invention can be implemented with a much simpler integrated circuit such as a 555 timer chip.

Pin 1 of driver circuit 91 relates to an unneeded function and is tied high. Pins 2 and 3 relate to unneeded functions and are grounded. Pin 4 is the frequency setting input and is connected to the junction of resistor 93 and capacitor 94. Pin 5 is electrical ground for driver circuit 91 and is connected to rail 19. Pin 6 of driver circuit 91 is the high frequency output and is coupled through capacitor 96 to inductor 97. Inductor 97 is magnetically coupled to inductor 78 and to inductor 79 (FIG. 3). As indicated by the small dots adjacent each inductor, inductors 78 and 79 are oppositely poled, thereby causing transistors $Q_5$ and $Q_6$ to switch alternately at a frequency determined by resistor 73, capacitor 74, and the voltage on rail 92.

Pin 7 of driver circuit 91 is connected to line B, the low voltage output of the boost circuit in FIG. 2. Pin 8 of driver circuit 91 is a voltage output for providing bias to the frequency determining network including resistor 93 and capacitor 94 which are series-connected between rail 92 and rail 19. Pin 8 is connected to rail 92 to provide voltage for the rest of the circuitry illustrated in FIG. 4.

When power is applied to the ballast, the boost circuit produces both a high voltage output and a low voltage output. The low voltage output is coupled by line B to driver circuit 91 which powers rail 92. Initially, transistors $Q_7$, $Q_8$, and $Q_9$ are non-conducting. As soon as driver circuit 91 begins operation and produces a voltage on rail 92, current flows through a first timer circuit including resistor 110 and capacitor 116. Capacitor 116 charges to a voltage determined by the voltage divider including series connected resistors 110 and 112 and this voltage is sufficient to turn on transistor $Q_8$. When transistor $Q_8$ turns on, transistor $Q_7$ is turned on.

Resistor 101 and transistor $Q_7$ are series-connected between rails 92 and 19. When transistor $Q_7$ is nonconducting, resistor 101 is connected in parallel with resistor 93 through diode 103. When resistor 101 is connected in parallel with resistor 93, the combined resistance is substantially less than the resistance of resistor 93 alone and the frequency of operation of driver circuit 91 is substantially higher than the resonant frequency of the LC output circuit. At this point, the output voltage across the resonant capacitor is not high enough to start lamp 73 (FIG. 3). However, power flowing through inductor 71 is coupled to the filaments of lamp 73 by inductors 74 and 75. After the lamp has warmed up a predetermined length of time, e.g. 0.75 seconds, transistor $Q_7$ conducts, thereby reverse biasing diode 103 and disconnecting resistor 101 from resistor 93. When diode 103 is reverse biased, the current into capacitor 94 is substantially reduced, the frequency of driver circuit 91 decreases to approximately the resonant frequency of inductor 71 and capacitor 72, and the output voltage across capacitor 72 increases.

when transistor $Q_8$ conducts, current flows through a shut-off timer including capacitor 120 and series connected resistor 121. If no lamp is connected to the ballast, capacitor 120 charges to a voltage determined by the voltage drop across resistor 133, turning on transistor $Q_{10}$. When transistor $Q_{10}$ turns on, line A is coupled to rail 92 and current flows through diode 141 to the base of transistor $Q_9$, turning on transistor $Q_9$.

Referring to FIG. 2, line A is coupled through resistor 68 and diode 67 to the base of transistor $Q_2$. The positive voltage on line A from rail 92 turns on $Q_2$, thereby turning off $Q_1$ and shutting off the boost circuit. With the boost circuit shut off, the voltage on line B decays and driver circuit 91 ceases operation, shutting off the inverter (FIG. 3). Since driver circuit 91 is turned off, the voltage on rail 92 collapses, shutting off SCR 130.

The control circuit does not require a holding current for SCR 130 to prevent the inverter and the boost circuit from operating. On the contrary, the operating voltage is removed from SCR 130, turning off the SCR and preventing the SCR from latching on. Cascaded timer circuits prevent the ballast from turning on immediately. The shut-off mechanism is entirely within the low voltage, low power portion of the ballast, further reducing power consumption when the ballast is shut off.

Referring to FIG. 4, the shut-off circuit including transistor $Q_{10}$ is prevented from turning off the ballast by an opposing current from line D. As illustrated in FIG. 3, line D is coupled through diode 86 and resistor 87 to the junction between lamp 73 and capacitor 81. With lamp 73 in place and operating normally, capacitor 81 charges to approximately half the voltage between rail 65 and rail 19.

Resistor 87 (FIG. 3) and diode 86 provide a resistive current path from sense capacitor 81 to capacitor 120 (FIG.

4). The current from line D opposes and is greater than the charging current through $Q_8$, causing the net voltage across capacitor 120 to forward-bias diode 131 as capacitor 120 charges from line D. When diode 131 is forward-biased, then the base-emitter junction of transistor $Q_{10}$ is reverse-biased, transistor Q10 is rendered non-conducting, and the shut-off circuit is reset. Since transistor $Q_{10}$ is non-conducting, the gate of SCR 130 is not coupled to rail 92, the SCR remains non-conducting, and the inverter continues to operate. The net voltage across capacitor 120 determines whether or not the ballast is turned off.

Referring to FIG. 3, the current through transistors $Q_5$ and $Q_6$ is converted into a voltage by series resistor 82. This voltage is coupled to line C by resistor 85 and diode 84. Line C is directly connected to the gate of SCR 130 and an excess voltage across resistor 82 causes SCR 130 to conduct, shutting off the ballast. This portion of the circuit protects the ballast when a lighted lamp is removed from an operating ballast. When the lamp is removed, the output voltage of the inverter rises swiftly and the corresponding voltage across resistor 82 triggers SCR 130, raising the operating frequency instantly, before the shut-off circuit can operate, thereby lowering the output voltage to a safe level.

As used herein, shutting off the ballast means reducing the output voltage either to a safe level or to zero volts. When SCR 130 conducts, transistors $Q_9$, $Q_8$, and $Q_7$ cause the frequency of the AC output to increase, thereby reducing the voltage drop across the resonant capacitor. Even if the boost circuit is turned off, the charge on capacitor 62 (FIG. 2) is sufficient to power driver circuit 91 for forty milliseconds or so. Thus, the frequency is raised to protect someone coming in contact with the ballast. Driver circuit 91 is turned off to prevent SCR 130 from latching. When driver circuit 91 turns off, the output voltage from the ballast goes to zero. After a predetermined delay, the start-up sequence begins.

In FIG. 4, when SCR 130 conducts, diode 141 is forward-biased and current flows through capacitor 143 and resistor 145. The voltage drop across resistor 145 causes the base-emitter junction of transistor $Q_9$ to become forward-biased and transistor $Q_9$ conducts, connecting the base of transistor $Q_8$ to rail 19 and discharging capacitor 116. Even after driver circuit 91 ceases operation, capacitor 143 keeps transistor $Q_9$ conducting, thereby preventing the ballast from restarting for a period determined by the RC time constant of a second timer circuit including capacitor 143 and resistors 145 and 146. Because the timing circuits are cascaded, the periods defined by the first and second timing circuits are consecutive and add up to a delay in excess of one second.

After capacitor 143 has discharged, transistor $Q_9$ turns off, permitting capacitor 116 to begin charging. If the AC input voltage has not been interrupted, the boost circuit will attempt to restart the driver circuit by producing a voltage on line 8. However, because transistor $Q_9$ is not conducting, transistor $Q_7$ is not conducting and the output frequency of the inverter is considerably higher than the resonant frequency of inductor 71 and capacitor 72 (FIG. 3). Thus, the output voltage across capacitor 72 is quite low.

When transistor $Q_9$ stops conducting, capacitor 116 can begin to charge, thereby turning on transistor $Q_8$ and transistor $Q_7$, reducing the frequency of drive circuit 91 approximately to the resonant frequency of the LC output and increasing the voltage across capacitor 72. If the fault condition still exists, the ballast shuts off again within 25 milliseconds, attempts a re-strike after about 1.5 seconds and the cycle continues until the fault is corrected or the AC input voltage is interrupted.

Figure 5:
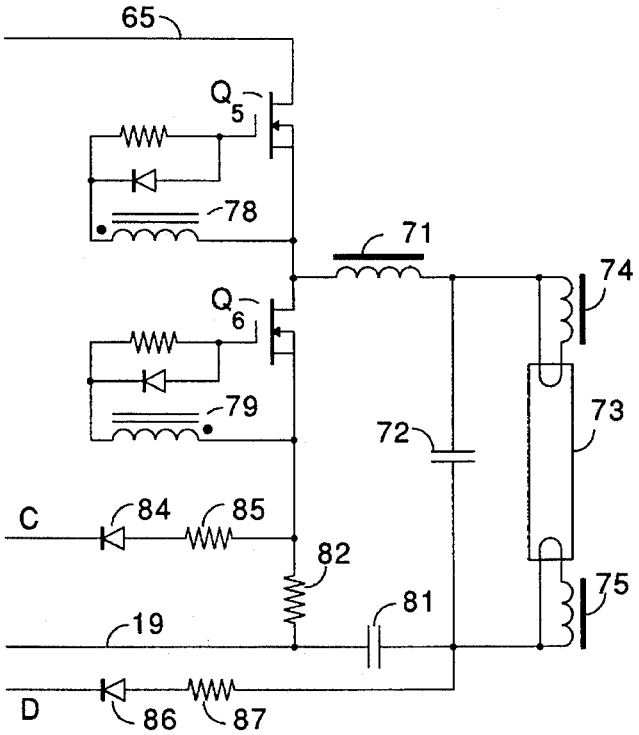
FIG. 5 is a schematic of an inverter constructed in accordance with an alternative embodiment of the invention.

FIG. 5 illustrates an alternative embodiment of the invention in which the sense capacitor is connected in series with the resonant capacitor. Capacitor 81 is connected between resonant capacitor 72 and rail 19. The output voltage from capacitor 81 is coupled by resistor 87 and diode 86 to line D as previously described. The operation of the embodiment of FIG. 5 is similar to that of FIG. 3 except that a smaller voltage is produced across capacitor 81.

The invention thus provides an improved electronic ballast in which fault sensing is accomplished with very little power dissipation either during a fault condition or during normal operation of the ballast. Unlike some ballasts of the prior art in which a triggered SCR must be furnished with a sustaining current, the invention relies on the charge stored in capacitors to shut off a low voltage, low power portion of the ballast, thereby disabling the entire ballast. Cascaded timing circuits provide the desired turn-on and turn-off characteristics to provide safe operation.

Having thus described the invention, it will be apparent to those of skill in the art that various modifications can be made within the scope of the invention. For example, the invention can be used with more than one lamp in series. While described in connection with a self-oscillating boost circuit, it is understood that a triggered or driven boost circuit can be used instead. The timing circuits can be changed to suit a particular application or to suit changing governmental or quasi-governmental regulations.

What is claimed is:

1. An electronic ballast for a gas discharge lamp, said ballast comprising:

a series resonant, parallel loaded, half-bridge inverter for producing a high frequency pulses from direct current;

said inverter including a half-bridge capacitor for shifting the level of said pulses to produce alternating current;

wherein a first DC voltage occurs across said half-bridge capacitor during normal operation and a second DC voltage occurs across said half-bridge capacitor when no lamp is attached to the ballast, said first DC voltage being greater than said second DC voltage; and a control circuit coupled to said half-bridge capacitor for sensing the DC voltage across said half-bridge capacitor and for turning off said inverter when said second DC voltage occurs.

2. The ballast as set forth in claim 1 wherein said inverter includes an inductor and a resonant capacitor connected in series with said half-bridge capacitor.

3. The ballast as set forth in claim 1 wherein said inverter includes a first output terminal;

a second output terminal;

an inductor and a resonant capacitor connected in a series circuit;

wherein said resonant capacitor is coupled between said first output terminal and electrical ground and wherein said half-bridge capacitor is coupled between said second output terminal and electrical ground.

4. The ballast as set forth in claim 1 and further including boost circuit having a high voltage voltage output and a low voltage output; and wherein said control circuit is powered by said low voltage output from said boost circuit.

5. The ballast as set forth in claim 4 wherein said control circuit includes:

a first timer circuit for defining a first period during which said inverter is on;

a second timer circuit for defining a second period during which said inverter remains off after said second DC voltage occurs;

wherein said first timer circuit and said second timer circuit are operated in cascade and said first period and said second period are consecutive.

6. The ballast as set forth in claim 5 wherein said control circuit includes:

a shut-off timer for turning off said ballast a predetermined period after power is applied to said inverter; and a resistive current path from said half-bridge capacitor to said shut-off timer for resetting said shut-off timer when said first DC voltage is present.

7. The ballast as set forth in claim 6 wherein shut-off timer is coupled to said second timer circuit and initiates said second period.

8. The ballast as set forth in claim 1 wherein said control circuit includes:

a shut-off timer for turning off said ballast a predetermined period after power is applied to said inverter; and a resistive current path from said half-bridge capacitor to said shut-off timer for resetting said shut-off timer when said first Dc voltage is present.

9. The ballast as set forth in claim 8 wherein said shut-off timer includes a capacitor charged by opposing currents and the net voltage across said capacitor determines whether or not said ballast is turned off.

10. An electronic ballast for a gas discharge lamp, said ballast comprising:

an AC input circuit for receiving alternating current from a power line and producing a direct current;

an inverter coupled to said AC input circuit and having a first output terminal and a second output terminal, said inverter converting direct current into high frequency pulses;

a capacitor coupled to one of said output terminals for shifting the level of said pulses to produce alternating current at said first output terminal and at said second output terminal, wherein there is a high DC voltage across said capacitor when a lamp is connected to said output terminals and is operating normally, otherwise there is a low DC voltage across said capacitor; and a control circuit coupled to said inverter and to said capacitor for sensing the DC voltage across said capacitor and for reducing said high frequency alternating current when the voltage across said capacitor is low.

11. The ballast as set forth in claim 10 wherein said inverter includes an inductor and a resonant capacitor connected in a series circuit and wherein said resonant capacitor is coupled to said first output terminal and said second output terminal.

12. The ballast as set forth in claim 10 wherein said inverter includes an inductor and a resonant capacitor connected in a series circuit and wherein said resonant capacitor is coupled to said first output terminal and to electrical ground.

13. The ballast as set forth in claim 10 wherein said control circuit includes:

a first timer circuit for defining a first period during which said lamp is warmed;

a second timer circuit for defining a second period during which said high frequency alternating current is reduced after a fault is detected;

wherein said first timer circuit and said second timer circuit are connected in cascade and said first period and said second period are consecutive.

14. The ballast as set forth in claim 13 wherein said control circuit includes:

a shut-off timer for reducing said high frequency alternating current a predetermined time after power is applied to said AC input circuit; and a resistive current path from said second output terminal to said shut-off timer for resetting said timer when said high voltage is present.

15. The ballast as set forth in claim 14 wherein shut-off timer is coupled to said second timer circuit and initiates said second period.

16. The ballast as set forth in claim 10 wherein said control circuit includes:

a shut-off timer for reducing said said high frequency alternating current a predetermined time after power is applied to said AC input circuit; and a resistive current path from said second output terminal to said shut-off timer for resetting said timer when said high voltage is present.

17. The ballast as set forth in claim 16 wherein said shut-off timer includes a timing capacitor charged by opposing currents and the net voltage across said timing capacitor determines whether or not said said high frequency alternating current is reduced.

* * * * *